US010789883B2

(12) United States Patent
Tzeng et al.

(10) Patent No.: US 10,789,883 B2
(45) Date of Patent: Sep. 29, 2020

(54) SENSING APPARATUS FOR DISPLAY PANEL AND OPERATION METHOD THEREOF

(71) Applicant: Novatek Microelectronics Corp., Hsinchu (TW)

(72) Inventors: Tzu-Chien Tzeng, Hsinchu (TW); Po-Hsiang Fang, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 56 days.

(21) Appl. No.: 16/000,891

(22) Filed: Jun. 6, 2018

(65) Prior Publication Data

US 2019/0130824 A1 May 2, 2019

Related U.S. Application Data

(60) Provisional application No. 62/580,996, filed on Nov. 2, 2017.

(51) Int. Cl.
*G09G 3/3225* (2016.01)
*G09G 3/3291* (2016.01)

(52) U.S. Cl.
CPC ..... *G09G 3/3225* (2013.01); *G09G 3/3291* (2013.01); *G09G 2300/0842* (2013.01); *G09G 2310/027* (2013.01); *G09G 2310/0294* (2013.01); *G09G 2320/0295* (2013.01)

(58) Field of Classification Search
CPC ..... G09G 3/3225; G09G 3/3291; G09G 2300/0842; G09G 2310/0294; G09G 2320/0295; G09G 2310/027
See application file for complete search history.

(56) References Cited

U.S. PATENT DOCUMENTS

2014/0152705 A1* 6/2014 Kwon ..... G09G 3/3275 345/690
2016/0012798 A1* 1/2016 Oh ..... G09G 3/325 345/205
2016/0163255 A1* 6/2016 Kim ..... G09G 3/2003 345/212
2017/0039946 A1* 2/2017 Xie ..... G09G 3/3258
2017/0287391 A1* 10/2017 Zhuang ..... G06F 13/14
2019/0156747 A1* 5/2019 Nie ..... G09G 3/3258

* cited by examiner

*Primary Examiner* — Jonathan A Boyd
(74) *Attorney, Agent, or Firm* — JCIPRNET

(57) ABSTRACT

The disclosure provides a sensing apparatus and an operation method thereof. The sensing apparatus includes a sensing circuit, an analog-to-digital converter (ADC) circuit, a disturbing circuit and an output circuit. The sensing circuit is configured to output a sensing signal indicating a sensing result of a sensing line of the display panel. The ADC circuit is coupled to the sensing circuit to receive the sensing signal and outputs sensing data related to the sensing signal. The disturbing circuit is coupled to the ADC circuit to receive the sensing data and generates a time-variant disturbance component to disturb the sensing data to generate disturbed data. The output circuit is coupled to the disturbing circuit to receive the disturbed data.

22 Claims, 6 Drawing Sheets

SENSING APPARATUS FOR DISPLAY PANEL AND OPERATION METHOD THEREOF

CROSS-REFERENCE TO RELATED APPLICATION

This application claims the priority benefit of U.S. provisional application Ser. No. 62/580,996, filed on Nov. 2, 2017. The entirety of the above-mentioned patent application is hereby incorporated by reference herein and made a part of this specification.

BACKGROUND

Field of the Invention

The invention relates to a display apparatus and more particularly, to a sensing apparatus for a display panel and an operating method thereof.

Description of Related Art

In a pixel circuit of a light emitting diode (LED) display panel such as an organic light emitting diode (OLED) display panel, the performance of the OLED declines along with the time of use. In order to compensate the performance decline of the OLED, a driving circuit senses the OLED through a sensing line of the display panel and converts a sensing result of the sensing line into sensing data to provide to an image processing circuit. The image processing circuit may generate compensated pixel data according to the sensing data. The driving circuit may drive the pixel circuit through data lines (i.e., source lines) of the display panel according to the compensated pixel data. Thereby, the performance decline of the OLED can be compensated.

The sensing result of the sensing line can be an analog signal, while the sensing data provided to the image processing circuit can be a digital signal. That is, the driving circuit can convert the sensing result of the sensing line into the sensing data with the use of an analog-to-digital converter (ADC). In anyway, a quantization and/or non-linear error between the sensing result and the sensing data may be generated by the ADC. Such error would cause the compensated image to have abnormal lines displayed by the display panel, which may be observed by a user.

SUMMARY

The invention provides a sensing apparatus and an operating method thereof for mitigating image abnormality resulting from quantization/non-linear error.

According to an embodiment of the invention, a sensing apparatus applicable to a driving circuit for driving a display panel is provided. The sensing apparatus includes a sensing circuit, an analog-to-digital converter (ADC) circuit, a disturbing circuit and an output circuit. The sensing circuit is configured to output a sensing signal indicating a sensing result of a sensing line of the display panel. The analog-to-digital converter circuit is coupled to the sensing circuit to receive the sensing signal and outputs sensing data related to the sensing signal. The disturbing circuit is coupled to the ADC circuit to receive the sensing data and generates a time-variant disturbance component to disturb the sensing data to generate disturbed data. The output circuit is coupled to the disturbing circuit to receive the disturbed data.

According to an embodiment of the invention, an operation method of a sensing apparatus is provided. The operation method includes: outputting, by a sensing circuit, a sensing signal indicating a sensing result of a sensing line of the display panel; outputting, by an analog-to-digital converter circuit, sensing data related to the sensing signal; generating, by a disturbing circuit, a time-variant disturbance component to disturb the sensing data to generate disturbed data; and receiving, by an output circuit, the disturbed data.

To sum up, in the sensing apparatus and the operating method of the embodiments of the invention, the disturbing circuit generates the time-variant disturbance component. The time-variant disturbance component is employed to disturb the sensing data output by the analog-to-digital converter circuit, so as to generate the disturbed data. In this way, the sensing apparatus can achieve mitigating image abnormality resulting from quantization/non-linear error.

To make the above features and advantages of the invention more comprehensible, embodiments accompanied with drawings are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
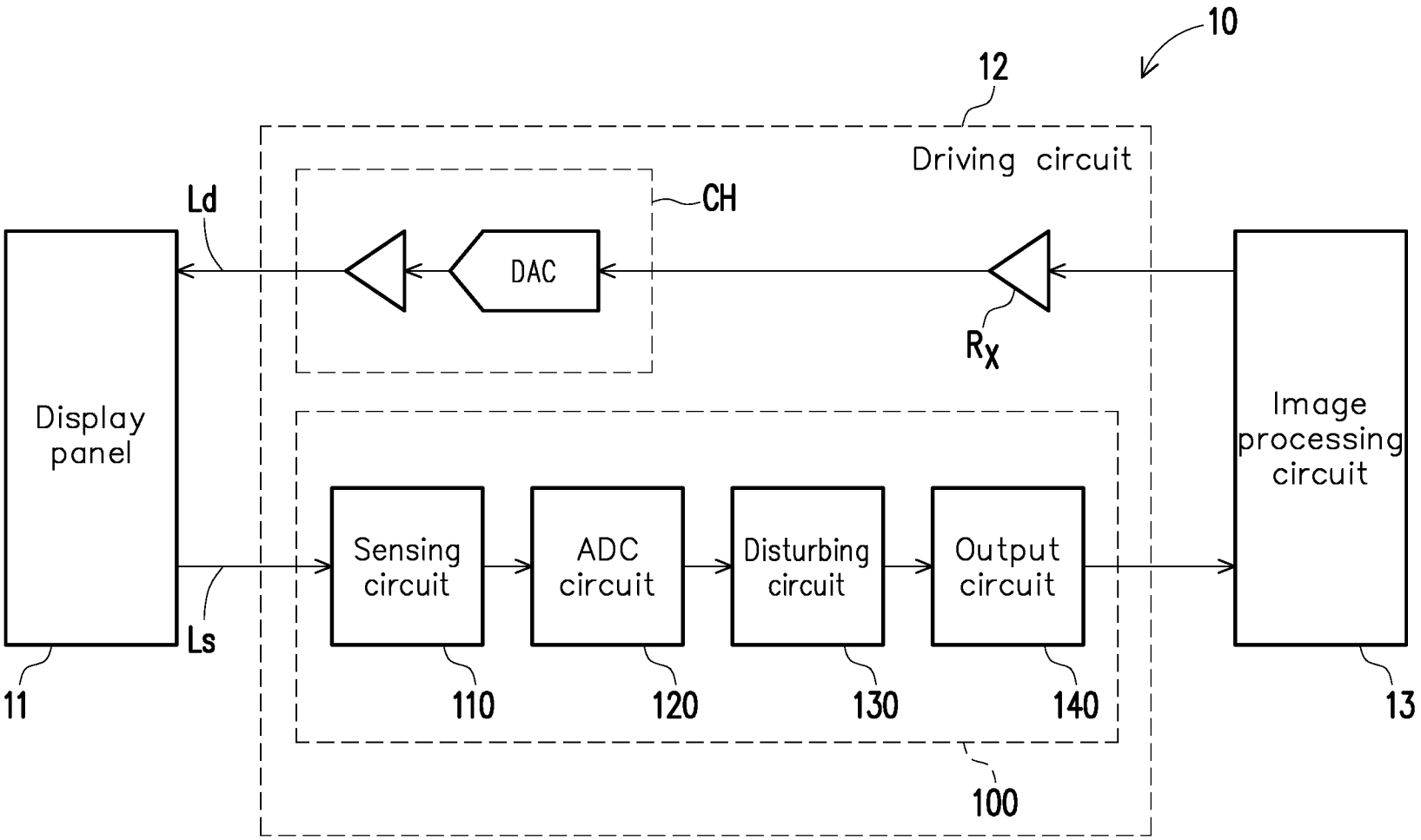
FIG. 1 is a schematic circuit block diagram illustrating a sensing apparatus according to an embodiment of the invention.

The term "couple (or connect)" herein (including the claims) are used broadly and encompass direct and indirect connection or coupling means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain coupling means. Moreover, elements/components/steps with same reference numerals represent same or similar parts in the drawings and embodiments. Elements/components/notations with the same reference numerals in different embodiments may be referenced to the related description.

FIG. 1 is a schematic circuit block diagram illustrating a sensing apparatus 100 according to an embodiment of the invention. A display apparatus 10 illustrated in FIG. 1 includes a display panel 11, a driving circuit 12 and an image processing circuit 13. Based on a design requirement, the display panel 11 may be a light emitting diode (LED) display panel such as an organic light emitting diode (OLED) display panel or other display panels. The OLED display panel may have any available configuration known in the art and thus, will not be described for brevity. The display panel 11 has a plurality of data lines (e.g., a data line Ld illustrated in FIG. 1) and a plurality of sensing lines (e.g., a sensing line Ls illustrated in FIG. 1). The data line is also referred to as a source line.

Figure 2:
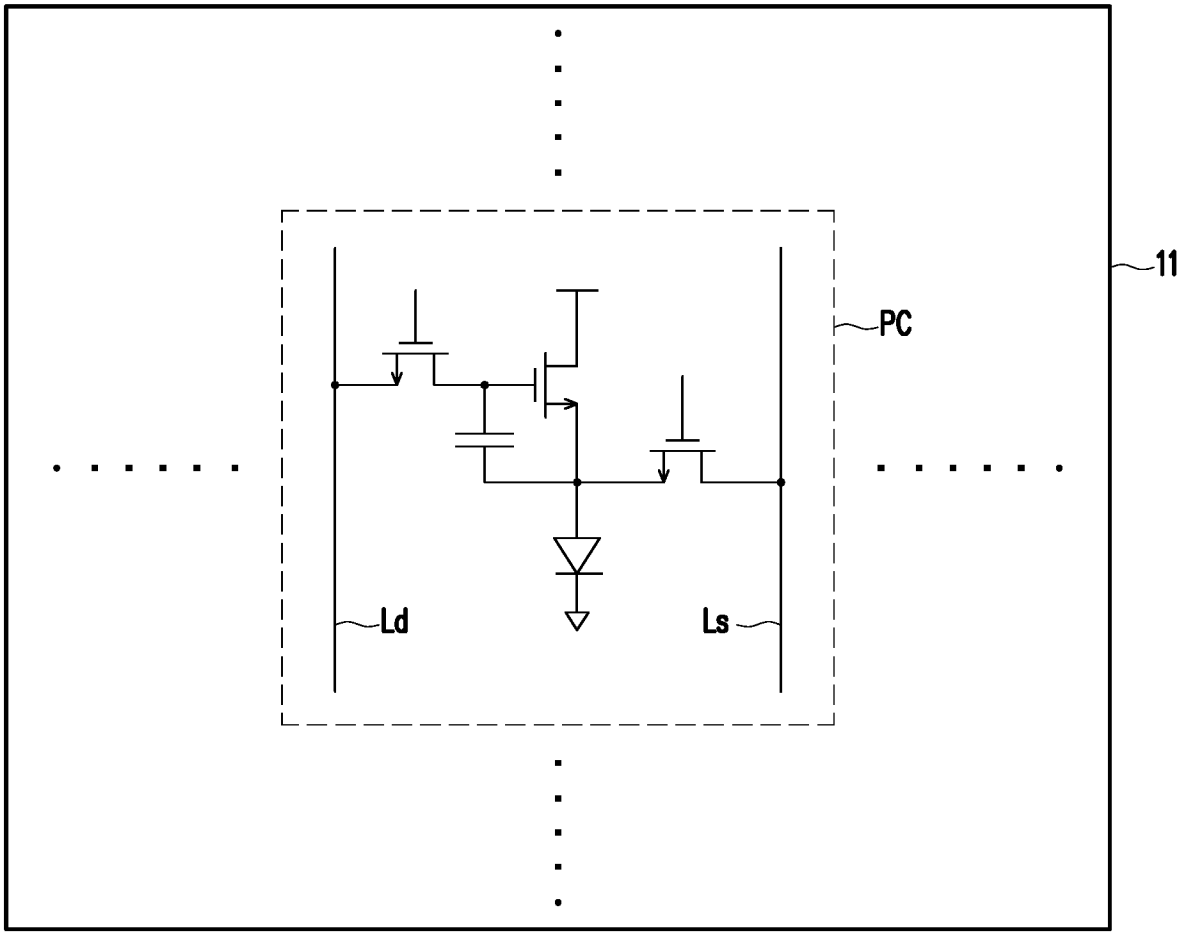
FIG. 2 is a schematic circuit diagram illustrating a pixel circuit of a display panel according to an embodiment of the invention.

The display panel 11 further has a pixel array, and the pixel array includes a plurality of pixel circuits. For example, FIG. 2 is a schematic circuit diagram illustrating a pixel circuit PC of the display panel depicted in FIG. 1 according to an embodiment of the invention. It is noted that the circuit illustrated in FIG. 2 is explained with application to FIG. 1 but is not limited to being applied to the configuration shown in FIG. 1. In the embodiment illustrated in FIG. 2, the display panel 11 includes the pixel circuit PC. The pixel circuit PC is coupled to a corresponding data line (e.g., the data line Ld illustrated in FIG. 1) and a corresponding sensing line (e.g., the sensing line Ls illustrated in FIG. 1) of the display panel 11. The pixel circuit PC illustrated in FIG. 2 may have any available conventional configuration known in the art and thus will not be described for brevity. In other embodiments, the implementation manner of the pixel circuit of the display panel 11 illustrated in FIG. 1 is not limited to that of the pixel circuit PC illustrated in FIG. 2.

Referring to FIG. 1, the driving circuit 12 includes a receiving circuit Rx, a channel circuit CH and the sensing apparatus 100. The receiving circuit Rx receives a pixel data string (i.e., compensated pixel data) from the image processing circuit 13 and provides the pixel data string to a plurality of channel circuits (e.g., the channel circuit CH illustrated in FIG. 1). The channel circuit CH converts the pixel data into an analog driving voltage and outputs the driving voltage to the corresponding data line (e.g., the data line Ld illustrated in FIG. 1) of the display panel 11. The channel circuit CH, the receiving circuit Rx and the image processing circuit 13 may have any available configurations known in the art and thus, will not be described for brevity.

In the embodiment illustrated in FIG. 1, the sensing apparatus 100 includes a sensing circuit 110, an analog-to-digital converter (ADC) circuit 120, a disturbing (or scrambling) circuit 130 and an output circuit 140. The sensing circuit 100 may sense (or sample) information related to a corresponding pixel circuit in the display panel 11 through the corresponding sensing line (e.g., the sensing line Ls illustrated in FIG. 1) of the display panel 11. The sensing circuit 110 may output a sense signal to the ADC circuit 120. The sensing signal indicates a sensing result of the sensing line Ls of the display panel 11.

Figure 3:
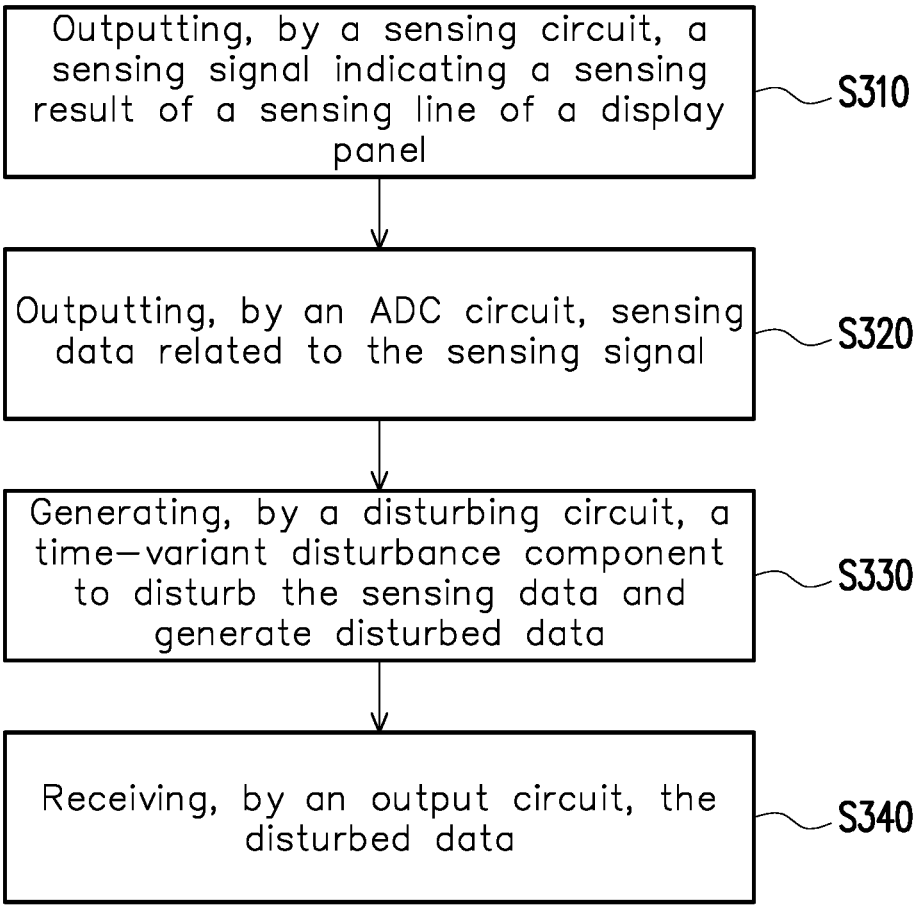
FIG. 3 is a flowchart illustrating an operation method of a sensing apparatus according to an embodiment of the invention.

FIG. 3 is a flowchart illustrating an operation method of a sensing apparatus according to an embodiment of the invention. It is noted that the flowchart illustrated in FIG. 3 is explained with application to FIG. 1 but is not limited to being applied to the configuration shown in FIG. 1. Referring to FIG. 1 and FIG. 3, in step S310, the sensing circuit 110 outputs a sensing signal indicating a sensing result the sensing line Ls of the display panel 11. The ADC circuit 120 is coupled to the sensing circuit 110 to receive the sensing signal. In step S320, the ADC circuit 120 outputs sensing data related to the sensing signal to the disturbing circuit 130. The disturbing circuit 130 is coupled to the ADC circuit 120 to receive the sensing data. In step S330, the disturbing circuit 130 generates a time-variant disturbance component to disturb (or scramble) the sensing data to generate disturbed data. The driving circuit 140 is coupled to the disturbing circuit 130. In step S340, the output circuit 140 receives the disturbed data and provides the disturbed data to the image processing circuit 13. The image processing circuit 130 may generate compensated pixel data according to the sensing data to provide to the driving circuit 12. The driving circuit 12 converts the compensated pixel data into a driving voltage and outputs the driving voltage to the corresponding data line (e.g., the data line Ld illustrated in FIG. 1) of the display panel 11. Thereby, performance decline of an OLED may be effectively compensated.

Figure 4:
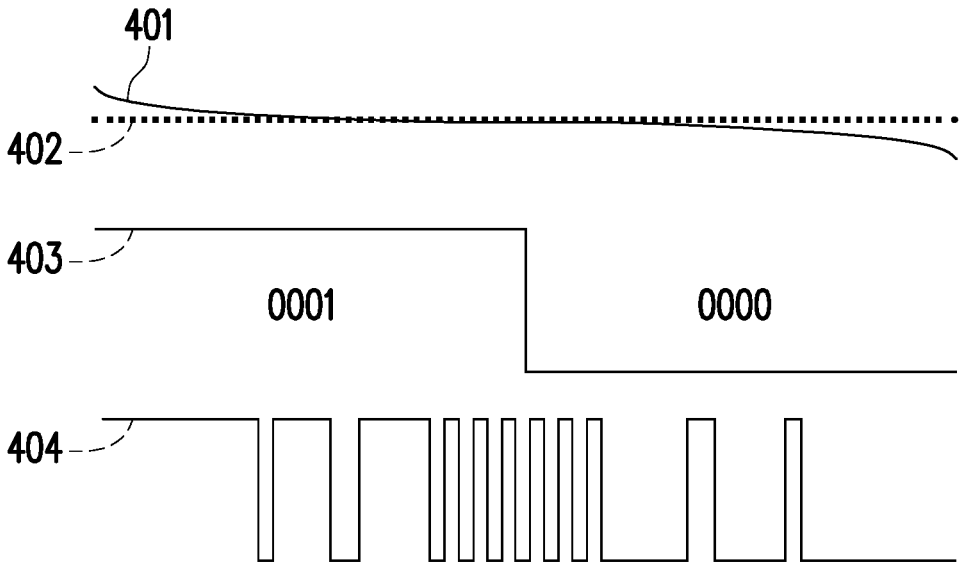
FIG. 4 is a schematic waveform diagram illustrating output signals of an analog-to-digital converter (ADC) circuit and a disturbance circuit according to an embodiment of the invention.

FIG. 4 is a schematic waveform diagram illustrating output signals of the ADC circuit 120 and the disturbance circuit 130 depicted in FIG. 1 according to an embodiment of the invention. In FIG. 4, the horizontal axis represents the time, and the vertical axis represents voltages. A curve 401 illustrated in FIG. 4 represents the sensing signal output by the sensing circuit 110, and a dotted line 402 represents a threshold voltage level for the ADC circuit 120 to perform an analog-to-digital converter operation. A curve 403 represents the least-significant-bit of the sensing data output by the ADC circuit 120. A curve 404 represents the disturbed data output by the disturbing circuit 130. When the curve 401 (representing the sensing signal) is greater than the dotted line 402, it is assumed that the sensing data (represented by the curve 403) output by the ADC circuit 120 is "0001". When the curve 401 (representing the sensing signal) is less than the dotted line 402, the sensing data (represented by the curve 403) is changed from "0001" to "0000". A quantization error exists in a transition state of the sensing data. The disturbing circuit 130 may load the time-variant disturbance component to the transition state of the sensing data (represented by the curve 403) to generate the disturbed data (represented by the curve 404). In terms of average energy, the time-variant disturbance component may turn a change of digital data to be smoother. Based on the nature of persistence of vision of human eyes, a user is prevented from observing the time-variant disturbance component on an image displayed by the display panel. Thus, the sensing apparatus 100 may mitigate image abnormality resulting from the quantization and/or non-linear error.

Figure 5:
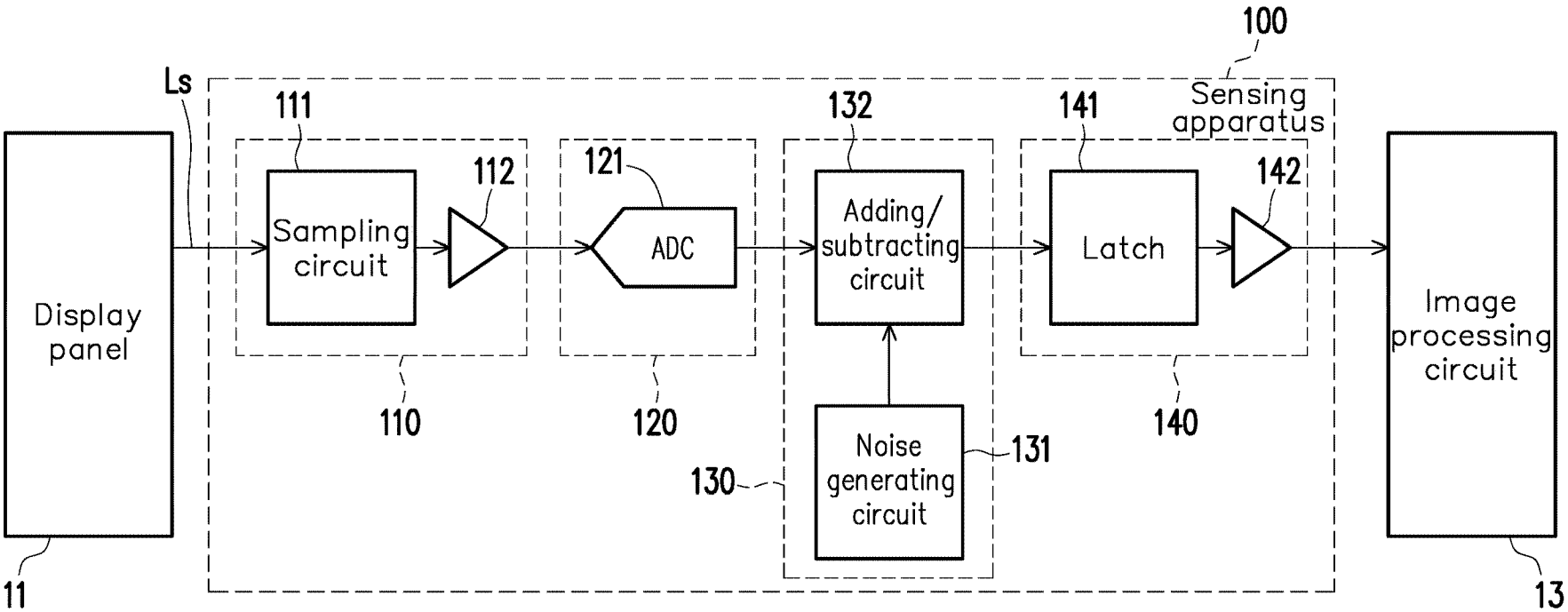
FIG. 5 is a schematic circuit block diagram illustrating a sensing apparatus according to an embodiment of the invention.
Figure 6:
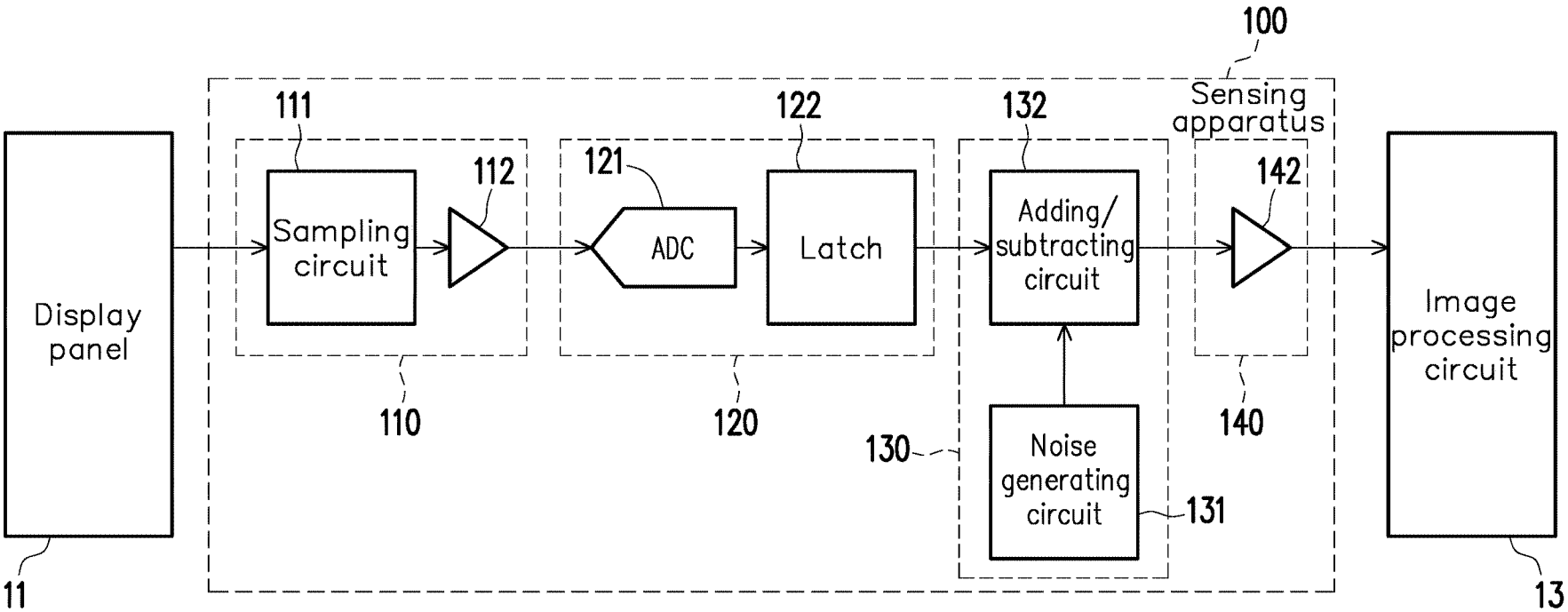
FIG. 6 is a schematic circuit block diagram illustrating a sensing apparatus according to another embodiment of the invention.

FIG. 5 is a schematic circuit block diagram illustrating the sensing apparatus depicted in FIG. 1 according to an embodiment of the invention. It is noted that the circuit illustrated in FIG. 6 is explained with application to FIG. 1 but is not limited to being applied to the configuration shown in FIG. 1. In the embodiment illustrated in FIG. 5, the sensing circuit 110 includes a sampling circuit 111 and a gain amplifier 112. The sampling circuit 111 is coupled to the corresponding sensing line (e.g., the sensing line Ls illustrated in FIG. 1) of the display panel 11. The sampling circuit 111 may sample the sensing result of the sensing line Ls to obtain a sampling result. The gain amplifier 112 is coupled to the sampling circuit 111 to receive the sampling result. The gain amplifier 112 outputs the sensing signal related to the sampling result to the ADC circuit 120. For example, the gain amplifier 112 gains the sampling result by a gain value which serves as the sensing signal. Based on a design requirement, the gain value may be any real number, for example, a positive number, a negative number or 1. The implementation manners of the sampling circuit 111 and the gain amplifier 112 are not limited in the present embodiment. For example, the sampling circuit 111 may be a conventional sampling circuit or other sampling circuits/elements, and the gain amplifier 112 may be a conventional gain amplifier or other gain circuits/elements. In some embodiments, the gain amplifier 112 may be integrated into the ADC circuit 120 based on a design requirement. In some other embodiments, the gain amplifier 112 may be omitted based on a design requirement.

In the embodiment illustrated in FIG. 5, the ADC circuit 120 includes an analog-to-digital converter (ADC) 121. An input terminal of the ADC 121 is coupled to the sensing circuit 110 to receive the sensing signal. An output terminal of the ADC 121 outputs the sensing data related to the sensing signal to the disturbing circuit 130. The implementation manner of the ADC 121 is not limited in the invention. For example, the ADC 121 may have any configurations known in the art or other ADC circuits/elements.

In the embodiment illustrated in FIG. 5, the disturbing circuit 130 includes a noise generating circuit 131 and an adding/subtracting circuit 132. The noise generating circuit 131 may generate a noise to the adding/subtracting circuit 132 and serves the noise as the time-variant disturbance component. A time average value of the noise (i.e., the time-variant disturbance component) is preferably a constant. Based on a design requirement, the constant may be any real number, for example, a positive number, a negative number or 0. The implementation manner of the noise generating circuit 131 is not limited in the present embodiment. For example, the noise generating circuit 131 may include a delta-sigma modulator, a Gaussian noise generator or a pseudo random bit sequence (PRBS) generator or other noise generating circuits/elements. Based on a design requirement, the delta-sigma modulator includes a multi-stage noise shaping (MASH) circuit or other modulation circuits/elements. Based on a design requirement, the PRBS generator includes a white-noise generator or other noise generating circuits/elements.

The adding/subtracting circuit 132 is coupled to the ADC circuit 120 to receive the sensing data. The adding/subtracting circuit 132 is coupled to the noise generating circuit 131 to receive the noise. The adding/subtracting circuit 132 adds (or subtracts) the noise (i.e., the time-variant disturbance component) into (or from) the sensing data to output the disturbed data to the output circuit 140.

In the embodiment illustrated in FIG. 5, the output circuit 140 includes a latch 141 and a transmitter interface circuit 142. An input terminal of the latch 141 is coupled to the disturbing circuit 130 to receive the disturbed data. The latch 141 latches the disturbed data to output latched data to the transmitter interface circuit 142. An input terminal of the transmitter interface circuit 142 is coupled to the latch 141 to receive the latched data. The transmitter interface circuit 142 is configured to transmit the latched data to an external apparatus (e.g., the image processing circuit 13 illustrated in FIG. 5). The implementation manners of the latch 141 and the transmitter interface circuit 142 are not limited in the present embodiment. For example, the latch 141 may be have any configuration known in the art or other latch circuits/elements, and the transmitter interface circuit 142 may have any configuration known in the art or other transmitter circuits/elements.

FIG. 6 is a schematic circuit block diagram illustrating the sensing apparatus 100 depicted in FIG. 1 according to an embodiment of the invention. It is noted that the circuit illustrated in FIG. 6 is explained with application to FIG. 1 but is not limited to being applied to the configuration shown in FIG. 1. The sensing circuit 110 illustrated in FIG. 6 may refer to the description related to FIG. 5 and thus, will not be repeated. In the embodiment illustrated in FIG. 6, the ADC circuit 120 includes an ADC 121 and a latch 122. An input terminal of the ADC 121 is coupled to the sensing circuit 110 to receive the sensing signal. An output terminal of the ADC 121 outputs digital data related to the sensing signal to the disturbing circuit 122. An input terminal of the latch 122 is coupled to the output terminal of the ADC 121 to receive the digital data. The latch 122 latches the digital data to output latched data which serves as the sensing data and is provided to the disturbing circuit 130. The implementation manners of the ADC 121 and the latch 122 are not limited in the invention. For example, the ADC 121 may have any configuration known in that art or other ADC circuits/elements, and the latch 122 may have any configuration known in the art or other latch circuits/elements.

In the embodiment illustrated in FIG. 6, the disturbing circuit 130 includes a noise generating circuit 131 and an adding/subtracting circuit 132. The adding/subtracting circuit 132 is coupled to an output terminal of the latch 122 to receive the sensing data. The noise generating circuit 131 and the adding/subtracting circuit 132 illustrated in FIG. 6 may be inferred with reference to the description related to FIG. 5 and thus, will not be repeated.

In the embodiment illustrated in FIG. 6, the output circuit 140 includes a transmitter interface circuit 142. An input terminal of the transmitter interface circuit 142 is coupled to an output terminal of the adding/subtracting circuit 132 of the disturbing circuit 130 to receive the disturbed data. The transmitter interface circuit 142 is configured to transmit the disturbed data to an external apparatus (e.g., the image processing circuit 13 illustrated in FIG. 6). The transmitter interface circuit 142 illustrated in FIG. 6 may be inferred with reference to the description related to FIG. 5 and thus, will not be repeated.

Based on the above, in the sensing apparatus and the operating method of the embodiments of the invention, the time-variant disturbance component can be employed to disturb the sensing data output by the analog-to-digital converter circuit, so as to generate the disturbed data. Thus, the sensing apparatus can mitigate the image abnormality resulting from the quantization and/or non-linear error.

Although the invention has been disclosed by the above embodiments, they are not intended to limit the invention. It will be apparent to one of ordinary skill in the art that modifications and variations to the invention may be made without departing from the spirit and scope of the invention. Therefore, the scope of the invention will be defined by the appended claims.

What is claimed is:

1. A sensing apparatus applicable to a driving circuit for driving a display panel, comprising:

a sensing circuit, configured to output a sensing signal indicating a sensing result of a sensing line of the display panel;

an analog-to-digital converter circuit, coupled to the sensing circuit to receive the sensing signal and outputting sensing data related to the sensing signal;

a disturbing circuit, coupled to the analog-to-digital converter circuit to receive the sensing data, and configured to generate a noise, serve the noise as a time-variant disturbance component, and disturb the sensing data to generate disturbed data according to the time-variant disturbance component;

an output circuit, coupled to the disturbing circuit to receive the disturbed data and an image processing circuit external to the driving circuit and configured to provide output data to the image processing circuit based on the disturbed data;

a receiving circuit, coupled to an image processing circuit and configured to receive compensated pixel data from the image processing circuit; and a plurality of channel circuits, configured to drive a plurality of data lines of the display panel based on the compensated pixel data.

2. The sensing apparatus according to claim 1, wherein the sense circuit comprises:

a sampling circuit, configured to be coupled to the sensing line of the display panel and sample the sensing result of the sensing line to obtain a sampling result.

3. The sensing apparatus according to claim 2, wherein the sensing circuit further comprises:

a gain amplifier, coupled to the sampling circuit to receive the sampling result and outputting the sense signal related to the sampling result to the analog-to-digital converter circuit.

4. The sensing apparatus according to claim 1, wherein the analog-to-digital converter circuit comprises:

an analog-to-digital converter, having an input terminal coupled to the sensing circuit to receive the sensing signal, wherein the analog-to-digital converter outputs the sensing data related to the sensing signal to the disturbing circuit.

5. The sensing apparatus according to claim 1, wherein the analog-to-digital converter circuit comprises:

an analog-to-digital converter, having an input terminal coupled to the sensing circuit to receive the sensing signal and outputting digital data related to the sensing signal; and a latch, having an input terminal coupled to the analog-to-digital converter to receive the sensing data and latching the digital data to output latched data serving as the sensing data to the disturbing circuit.

6. The sensing apparatus according to claim 1, wherein the disturbing circuit comprises:

a noise generating circuit, generating the noise; and an adding/subtracting circuit, coupled to the analog-to-digital converter circuit to receive the sensing data, coupled to the noise generating circuit to receive the noise, serving the noise as the time-variant disturbance component and adding or subtracting the sensing data by the noise to output the disturbed data to the output circuit.

7. The sensing apparatus according to claim 6, wherein the noise generating circuit comprises a delta-sigma modulator, a Gaussian noise generator or a pseudo random bit sequence (PRBS) generator.

8. The sensing apparatus according to claim 7, wherein the delta-sigma modulator comprises a multi-stage noise shaping (MASH) circuit.

9. The sensing apparatus according to claim 7, wherein the PRBS generator comprises a white-noise generator.

10. The sensing apparatus according to claim 1, wherein the output circuit comprises:

a latch, having an input terminal coupled to the disturbing circuit to receive the disturbed data and latching the disturbed data to output latched data; and a transmitter interface circuit, having an input terminal coupled to the latch to receive the latched data and configured to transmit the latched data to the image processing circuit.

11. The sensing apparatus according to claim 1, wherein the output circuit comprises:

a transmitter interface circuit, having an input terminal coupled to the disturbing circuit to receive the disturbed data and configured to transmit the disturbed data to the image processing circuit.

12. The sensing apparatus according to claim 1, wherein a time average value of the time-variant disturbance component is a constant.

13. An operation method of a sensing apparatus, comprising:

outputting, by a sensing circuit, a sensing signal indicating a sensing result of a sensing line of a display panel;

outputting, by an analog-to-digital converter circuit, sensing data related to the sensing signal;

generating, by a disturbing circuit, a noise, serving the noise as a time-variant disturbance component, and disturbing the sensing data to generate disturbed data according to the time-variant disturbance component;

receiving the disturbed data from the disturbing circuit and providing output data to an image processing circuit based on the disturbed data by an output circuit, wherein the image processing circuit is external to the driving circuit;

receiving, by a receiving circuit, compensated pixel data from the image processing circuit; and driving, by a plurality of channel circuits, a plurality of data lines of the display panel based on the compensated pixel data.

14. The operation method according to claim 13, wherein the step of outputting the sensing result comprises:

sampling, by a sampling circuit, the sensing result of the sensing line to obtain a sampling result; and outputting, by a gain amplifier, the sensing signal related to the sampling result to the analog-to-digital converter circuit.

15. The operation method according to claim 13, wherein the step of outputting the sensing result comprises:

outputting, by an analog-to-digital converter, the sensing data related to the sensing signal to the disturbing circuit.

16. The operation method according to claim 13, wherein the step of outputting the sensing data comprises:

outputting, by an analog-to-digital converter, digital data related to the sensing signal; and latching, by a latch, the digital data to output latched data serving as the sensing data to the disturbing circuit.

17. The operation method according to claim 13, wherein the step of generating the disturbed data comprises:

generating, by a noise generating circuit, the noise; and adding or subtracting, by an adding/subtracting circuit, the sensing data by the noise to output the disturbed data to the output circuit.

18. The operation method according to claim 17, wherein the noise generating circuit comprises a delta-sigma modulator, a Gaussian noise generator or a pseudo random bit sequence (PRBS) generator.

19. The operation method according to claim 13, wherein the step of receiving the disturbed data by the output circuit comprises:

latching, by a latch, the disturbed data to output latched data; and transmitting, by a transmitter interface circuit, the latched data to the image processing circuit.

20. The operation method according to claim 13, wherein the step of receiving the disturbed data by the output circuit comprises:

transmitting, by a transmitter interface circuit, the disturbed data to the image processing circuit.

21. A sensing apparatus applicable to a driving circuit for driving a display panel, comprising:

a sensing circuit, configured to output a sensing signal indicating a sensing result of a sensing line of the display panel;

an analog-to-digital converter circuit, coupled to the sensing circuit to receive the sensing signal and outputting sensing data related to the sensing signal;

a disturbing circuit, coupled to the analog-to-digital converter circuit to receive the sensing data and generating a time-variant disturbance component to disturb the sensing data and generate disturbed data, wherein the disturbing circuit comprises:

a noise generating circuit, generating a noise; and an adding/subtracting circuit, coupled to the analog-to-digital converter circuit to receive the sensing data, coupled to the noise generating circuit to receive the noise, serving the noise as the time-variant disturbance component and adding or subtracting the sensing data by the noise to output the disturbed data to the output circuit; and an output circuit, coupled to the disturbing circuit to receive the disturbed data.

22. An operation method of a sensing apparatus, comprising:

outputting, by a sensing circuit, a sensing signal indicating a sensing result of a sensing line of a display panel;

outputting, by an analog-to-digital converter circuit, sensing data related to the sensing signal;

generating, by a disturbing circuit, a time-variant disturbance component to disturb the sensing data and generate disturbed data, wherein the step of generating the disturbed data comprises:

generating, by a noise generating circuit, a noise serving as the time-variant disturbance component; and adding or subtracting, by an adding/subtracting circuit, the sensing data by the noise to output the disturbed data to the output circuit; and receiving, by an output circuit, the disturbed data.

* * * * *